US010836617B2

(12) United States Patent
Holmberg et al.

(10) Patent No.: US 10,836,617 B2
(45) Date of Patent: Nov. 17, 2020

(54) METHOD FOR OPERATING TOWING WINCH AND ELECTRIC DRIVE FOR TOWING WINCH

(71) Applicant: ABB Schweiz AG, Baden (CH)

(72) Inventors: Mikael Holmberg, Porvoo (FI); Gayomurd Desai, Auckland (NZ)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/661,449

(22) Filed: Oct. 23, 2019

(65) Prior Publication Data

US 2020/0131011 A1 Apr. 30, 2020

(30) Foreign Application Priority Data

Oct. 31, 2018 (EP) ..... 18203690

(51) Int. Cl.
*B63B 21/56* (2006.01)
*B66D 1/48* (2006.01)
(Continued)

(52) U.S. Cl.
CPC ..... *B66D 1/485* (2013.01); *B63B 21/56* (2013.01); *B63B 35/68* (2013.01); *B66D 1/505* (2013.01); *B66D 2700/0141* (2013.01)

(58) Field of Classification Search
CPC ..... B66D 1/485; B66D 1/505; B66D 2700/0141; B63B 21/56; B63B 35/68
See application file for complete search history.

(56) References Cited

U.S. PATENT DOCUMENTS 3,536,298 A * 10/1970 Deslierres ..... B66D 1/50 114/254
3,670,988 A * 6/1972 Leonard ..... B66D 1/36 242/397.2

(Continued)

FOREIGN PATENT DOCUMENTS

EP 0174067 A1 * 3/1986 ..... B63B 21/16
WO WO-2012166864 A2 * 12/2012 ..... E21B 25/02
WO 2017167892 A1 10/2017

OTHER PUBLICATIONS

European Patent Office, Extended Search Report issued in corresponding Application No. 18203690.5, dated Apr. 26, 2019, 6 pp.

*Primary Examiner* — S. Joseph Morano
*Assistant Examiner* — Jovon E Hayes
(74) *Attorney, Agent, or Firm* — Taft Stettinius & Hollister LLP; J. Bruce Schelkopf

(57) ABSTRACT

A method for operating a towing winch and an electric drive for a towing winch, the towing winch including a rotatable winch drum for spooling a spoolable medium, and an electric motor operably coupled to the winch drum to rotate the winch drum, wherein the electric drive is configured to be operably coupled to the electric motor, and configured to control, during a towing of at least one object connected to the spoolable medium, a tension of the spoolable medium between the winch drum and the at least one object to be towed to be equal to or lower than a tension limit value; and monitor, during the towing, a roll angle of the tug, and in response to the monitored roll angle of the tug being outside of a predetermined range, lower the tension limit value providing roll compensation.

15 Claims, 2 Drawing Sheets

(51) Int. Cl.
*B63B 35/68* (2006.01)
*B66D 1/50* (2006.01)

(56) References Cited

U.S. PATENT DOCUMENTS

| | | | | | |
|---|---|---|---|---|---|
| 3,902,701 | A * | 9/1975 | Orme | B65H 75/4402 | 254/415 |
| 4,312,496 | A * | 1/1982 | Norminton | B63B 21/56 | 114/254 |
| 4,349,180 | A * | 9/1982 | Charles | B63G 8/42 | 114/254 |
| 4,436,049 | A * | 3/1984 | Ante | G01M 10/00 | 114/254 |
| 5,609,120 | A * | 3/1997 | Eronen | B63B 35/68 | 114/253 |
| 9,783,399 | B2 * | 10/2017 | Hausladen | B66D 1/39 | |
| 9,950,914 | B2 * | 4/2018 | Holmberg | B66D 1/38 | |
| 10,202,264 | B2 * | 2/2019 | Moll | B66D 1/485 | |
| 10,640,344 | B1 * | 5/2020 | Hall | B66D 1/00 | |
| 2015/0266707 | A1 * | 9/2015 | Holmberg | B66D 1/38 | 254/362 |
| 2017/0144872 | A1 * | 5/2017 | Holmberg | B66D 1/505 | |
| 2020/0131011 | A1 * | 4/2020 | Holmberg | B63B 21/56 | |

* cited by examiner

METHOD FOR OPERATING TOWING WINCH AND ELECTRIC DRIVE FOR TOWING WINCH

FIELD OF THE INVENTION

The invention relates to operating a towing winch, and to an electric drive for a towing winch.

BACKGROUND OF THE INVENTION

Winches may be used in connection with many applications. An example is a towing winch of a tug. A towing winch of a tug may comprise a winch drum rotatable about an axis and used for spooling a tow line, which may be any kind of spoolable medium such as a cable, a rope, a wire or a chain, for example. In case of a winch used for towing, for example, the spoolable medium is to be connected between the towing winch of the tug and the at least one object to be towed. Such a winch used for towing may further comprise an electric drive and an electric motor, which is configured to rotate the winch drum about the axis of rotation thereof during spooling in or spooling out of the spoolable medium. The electric drive can be an AC drive or a DC drive and the electric motor can be an AC motor, such as an asynchronous motor or a synchronous motor, or a DC motor, respectively, for example.

A towing functionality of a winch used for towing an object, for example, can control the tension of the spoolable medium between the tug and the object to be towed by means of the electric drive. During the towing, the tension of the spoolable medium between the tug and the at least one object to be towed can be automatically adjusted by suitably controlling the electric drive that controls the electric motor of the winch used for the towing. The tension of the spoolable medium between the tug and the at least one object to be towed can be set and kept at an appropriate predetermined level, which may be represented by a single value or a value range, for instance. If the spoolable medium between the tug and the at least one object to be towed is too loose or if the spoolable medium is too tight, the spoolable medium might break or the operation might become unstable. Hence, electrically driven towing winches may have a target to keep a stable rope tension between the tug and the object to be towed. The electric motor can be controlled by the electric drive such that the spoolable medium is either tightened (spooled in) or loosened (spooled out) towards the predetermined tension level. And when the predetermined tension level is reached, the tightening or loosening may be stopped. In other words, the electric motor of the winch may be controlled in a stepless way down to zero speed, when the predetermined tension level is reached. The electrical motor may then stand still at zero speed of rotation and may hold essentially constant torque to keep the tension of the spoolable medium stable. Such control may include a set tension limit value which represents a maximum allowed tension for the spoolable medium between the tug and the at least one object to be towed such that the tension should be kept equal to or lower than the tension limit value.

A problem related to the above solution is that under certain circumstances, due to e.g. a position of the tug with respect to the at least one object to be towed and/or weather conditions, a risk of dangerous operation can develop if the force directed at the tug by the spoolable medium causes or contributes to the roll angle of the tug to increase beyond safe operating limits such that the tug may be in danger to capsize.

BRIEF DESCRIPTION OF THE INVENTION

The object of the invention is thus to provide a method and an apparatus for implementing the method so as to solve or at least alleviate the above problem. The object of the invention is achieved with a method, a computer program product, an electric drive, and a winch arrangement that are characterized by what is stated in the independent claims. Preferred embodiments of the invention are described in the dependent claims.

The invention is based on the idea of monitoring by the electric drive, during a towing, the roll angle of the tug, and in response to the monitored roll angle of the tug being outside of a predetermined range, lowering by the electric drive the tension limit value of the tension of the spoolable medium between the winch drum and the at least one object to be towed.

An advantage of the invention is that the stability and safety of the tug can be increased.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

Figure 1:
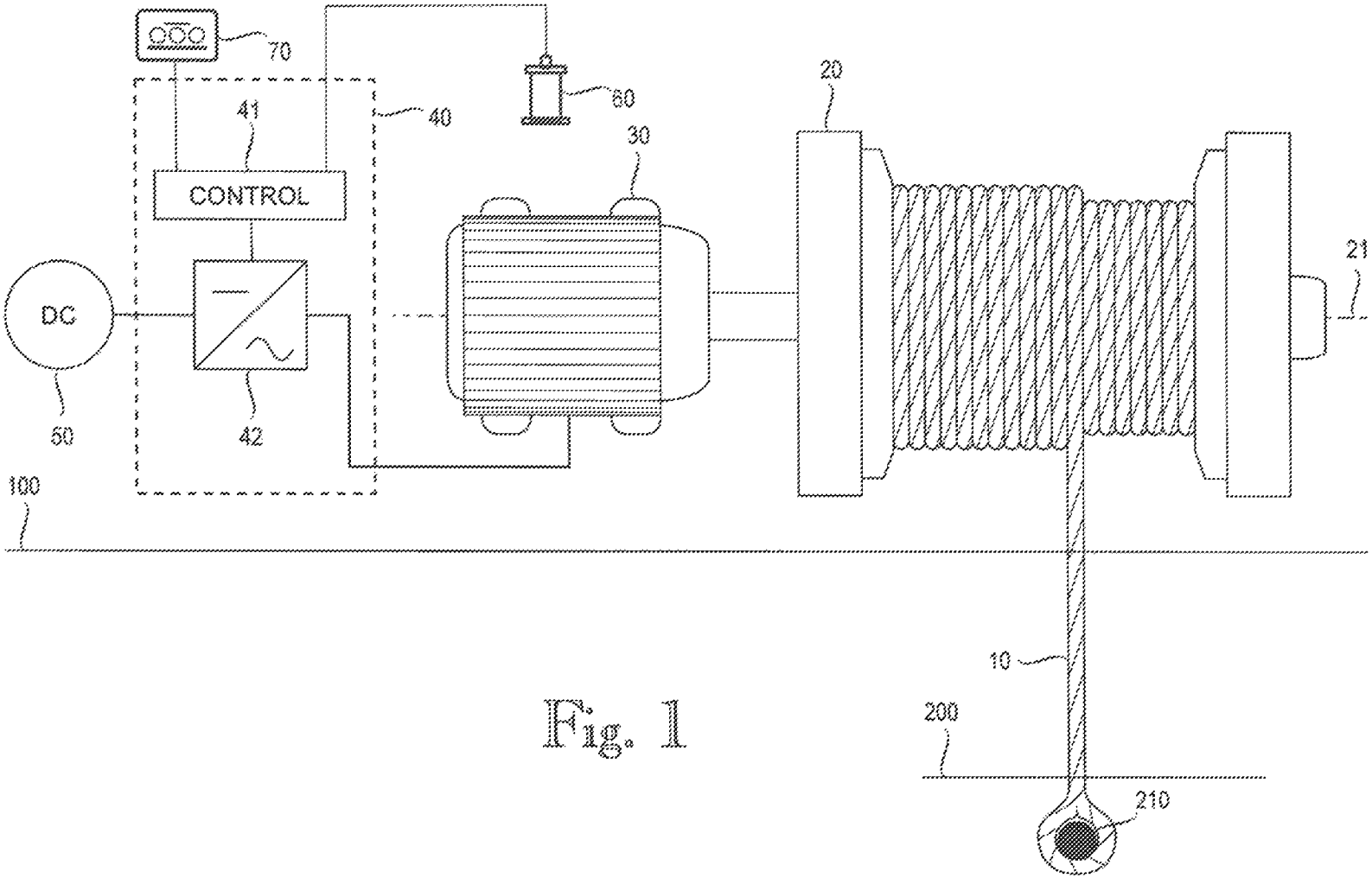
FIG. 1 illustrates a winch arrangement according to an embodiment.

FIG. 1 illustrates a simplified diagram of a winch arrangement of a tug 100 according to an embodiment. Herein the term tug, or tugboat, generally refers to a vessel capable of towing at least one object, such as another vessel or a rig, for instance. A vessel may be a ship, a boat, a raft or generally a craft designed for water transportation in a sea, an ocean, a lake, a river, a channel, a canal, or any parts thereof, for example. The exemplary winch arrangement of FIG. 1 can be used for towing one or more objects 200, for example. The towing of the at least one object 200 may include moving and/or holding stationary the at least one object 200 to be towed. Such moving and/or holding stationary may be performed by the tug 100 itself and/or by the winch of the tug, for example. In other words, the towing may include pushing and/or pulling the at least one object 200 to be towed by direct contact by the tug 100 and/or by means of the tow line 10. Examples of possible towing modes include conventional towing and escort towing. The figure only shows components necessary for understanding the various embodiments.

The exemplary winch arrangement comprises a winch drum 20 for spooling a spoolable medium (tow line) 10, which winch drum is rotatable about an axis of rotation 21. The spoolable medium 10 may comprise a cable, a rope, a wire, a chain or a combination thereof, for example. In the example of FIG. 1, the winch arrangement further comprises an electric motor 30, which is operably coupled to the winch drum 20 such that the winch drum can be rotated with the electric motor 30. The electric motor 30 may be connected to the winch drum 20 directly or via one or more other components or devices, such as a gearbox (not shown in the figure). While the exemplary winch arrangement of FIG. 1 comprises one electric motor 30 operably coupled to the winch drum 20, there could be more than one electric motors 30 operably coupled to the same winch drum 20 and configured to rotate the winch drum 20. In such a case, the two or more electric motors 30 may be configured to work together in a suitable manner for load sharing purposes, for example. The electric motor 30 driving the winch drum 20 can be of any type. Possible examples include an asynchronous AC motor, such as an induction motor, a synchronous AC motor, and a DC motor, for instance. Possible examples of the synchronous AC motor include non-excited motors, such as a reluctance motor, a hysteresis motor and a permanent magnet motor, and DC-excited motors, for example. It should be noted that the use of the embodiments described herein is not limited to systems employing any specific fundamental frequency or any specific voltage level, for example. The exemplary winch arrangement further comprises an electric drive 40, which in the example of FIG. 1 comprises an inverter 42, for feeding the electric motor 30 from a DC power supply 50. An inverter is a device used, for instance, for controlling a motor. Herein 'inverter' generally refers to an electronic device or circuitry that is able to convert direct current to alternating current. An example of the inverter is a semiconductor bridge implemented by means of controllable semiconductor switches, such as IGBTs (Insulated-Gate Bipolar Transistor) or FETs (Field-Effect Transistor), which are controlled according to a modulation or control scheme used. The control of the electric motor 30 may be implemented reliably by means of the inverter 42 in such a manner that the motor 30 accurately implements a desired speed and/or torque instruction, for example. Examples of control methods for electric drives include frequency control, flux vector control and direct torque control, for example. The inverter 42 could also be a part of a frequency converter, for instance. The exemplary embodiment of FIG. 1 further comprises a control arrangement 41 of the electric drive 40, which may be used to control the inverter 42 and, thus, the electric motor 30 and to operate the winch. The control arrangement 41 may be a separate unit or a part of the inverter 42 or some other unit, for example. The winch arrangement may comprise suitable I/O (Input-Output) means 70, such as a keyboard and display unit or another separate terminal unit, which may be connected to the control arrangement 41 in a wired or wireless manner. Thus, an operator or a user of the winch arrangement can operate the winch through such I/O means 70, for instance. The I/O means 70 could be included in the electric drive 40 either alternatively or additionally. According to an embodiment, the electric drive 40, including at least the control arrangement 41 and the inverter 42, is realized as a single enclosure unit. Thus, the parts of the electric drive 40 may be integrated in a single enclosure, such as a cabinet. FIG. 1 also illustrates a motion reference device 60 connected to the electric drive 40. According to an embodiment, such a motion reference device 60 may be included in the electric drive 40. The motion reference device may be any kind of device capable of measuring at least the roll angle of the tug 100. An example of such a motion reference device is a Motion Reference Unit (MRU), which is a solid-state device with single- or multi-axis motion sensors. The term roll angle herein generally refers to a rotational angle of a vessel about its longitudinal (front-back) axis. The roll angle thus generally indicates an offset or a deviation from normal, e.g vertical or upright position, around the longitudinal axis. FIG. 1 further illustrates a fixing point 210 for the spoolable medium 10, wherein the spoolable medium 10 is to be fixed to the fixing point 210 of an object 200 to be towed during the towing, for example.

Figure 2:
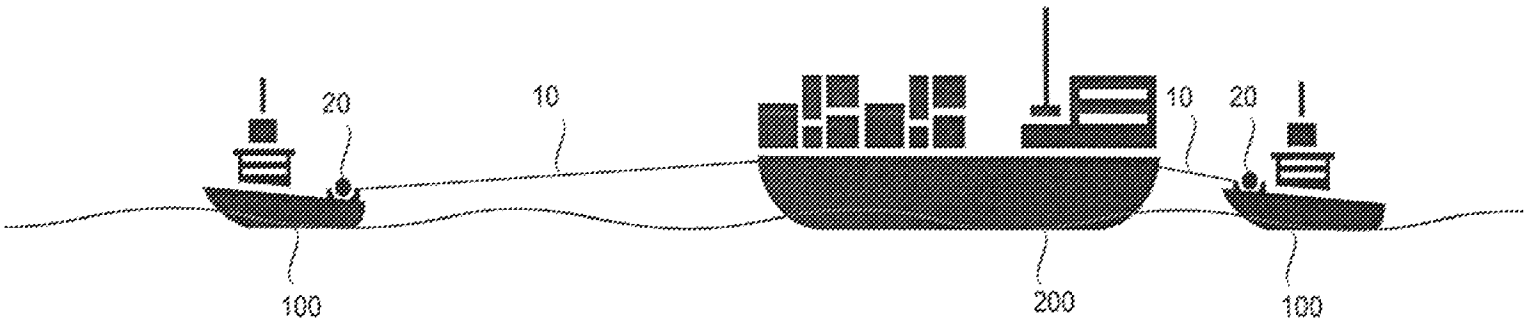
FIG. 2 illustrates a diagram according to an embodiment.

FIG. 2 illustrates an example of towing operation according to an embodiment. In the figure an object 200 to be towed, in this example a ship, is being towed by two tugs 100; one tug 100 in front of the towed vessel 200 and another tug 100 following the towed vessel 200.

According to an embodiment, the towing winch of the tug 100 can be operated as follows. During a towing of at least one object 200 connected to the spoolable medium 10, a tension of the spoolable medium 10 between the winch drum 20 and the at least one object 200 to be towed is controlled, preferably essentially continuously during the towing, by the electric drive 40 to be equal to or lower than a tension limit value. According to an embodiment, the tension limit value thus indicates the maximum allowed tension for the spoolable medium 10 between the tug 100 and the at least one object 200 to be towed. The tension limit value may be predetermined and/or set by a user or an operator of the winch arrangement or by the winch arrangement itself, for example. Moreover, during the towing, the roll angle of the tug 100 is monitored by the electric drive 40, and in response to the monitored roll angle of the tug 100 being outside of a predetermined range, the tension limit value is lowered by the electric drive 40. Thus, in a situation in which the roll angle of the tug 100 is increased outside of the predetermined range, the tension limit value is automatically reduced by the electric drive 40. This results in the spoolable medium 10 being spooled out reducing the roll angle of the tug 100 and hence stabilizing the tug 100 position. As a result, auto roll compensation can be provided. The monitoring of the roll angle of the tug 100 may be performed essentially continuously during the towing.

According to an embodiment, during the towing the winch drum 20 may be driven with the electric motor 30 such that the tension of the spoolable medium 10 reaches a desired tension level (being equal to or lower than the tension limit value), and, in response to the monitored tension of the spoolable medium 10 reaching the predetermined tension level, the driving speed of the electric motor 30 may be set to zero. The torque of the electric motor 30 may be kept essentially constant such that the tension of the spoolable medium 10 is within the predetermined tension level, for instance. The tension of the spoolable medium 10 is in any case limited to or below the tension limit value. According to an embodiment, any mechanical brake of the towing winch may be kept open during the towing and thus the tension of the spoolable medium 10 can be controlled solely by the electric drive 40 and the electric motor 30, which may also act as a brake when needed. According to an embodiment, in addition to keeping the tension of the spoolable medium 10 within the predetermined tension level, a distance(s) between the tug 100 and the at least one object 200 to be towed may be monitored and kept at a predetermined distance value or within a predetermined distance range by the electric drive 40. Then, if the distance between the tug 100 and the at least one object 200 to be towed changes from said predetermined distance value or goes outside of said predetermined distance range because the spoolable medium 10 is spooled out in order to reduce the roll angle of the tug 100, the distance may be automatically restored to the predetermined distance value or predetermined distance range by the electric drive 40 after the tug roll angle has been stabilized back to its predetermined range, for example. As a result, auto payout and haul functionality can be provided.

According to an embodiment, the tension limit value is lowered proportionally to the roll angle of the tug 100 by the electric drive 40 in response to the monitored roll angle of the tug being outside of a predetermined range. Such lowering of the tension limit value may be performed in stepless or stepwise manner, for example. Moreover, the rate at which the tension limit value is lowered proportionally to the roll angle may be adjustable by a user or an operator of the winch arrangement or by the winch arrangement itself, for example. According to another embodiment, the tension limit value may be lowered to a predetermined lower value or by a fixed amount by the electric drive 40 in response to the monitored roll angle of the tug being outside of a predetermined range.

According to an embodiment, during the towing, in response to the monitored roll angle of the tug 100 returning back within said predetermined range after being outside of the predetermined range, the tension limit value is increased by the electric drive 40. According to an embodiment, the tension limit value may be increased back to its original or prior value it had before the monitored roll angle of the tug 100 went outside of the predetermined range. According to an embodiment, the tension limit value may also be increased back to a nominal or default value, for example. Accordingly, the winch arrangement can automatically restore the tension limit value after the tug 100 position is stabilized. This may be performed in a gradual or non-gradual manner.

According to an embodiment, the monitoring of the roll angle of the tug 100 by the electric drive 40 comprises measuring the roll angle of the tug in the electric drive. According to an embodiment, the electric drive 40 may comprise a motion reference device 60 configured to measure the roll angle of the tug 100. According to another embodiment, the monitoring of the roll angle of the tug 100 by the electric drive 40 may comprise receiving the roll angle of the tug in the electric drive. According to an embodiment, the electric drive 40 is connected to a motion reference device 60 configured to measure the roll angle of the tug and output the measured roll angle. The electric drive 40 can then receive the roll angle of the tug 100 output by the motion reference device 60.

According to an embodiment, the tension of the spoolable medium 10 is controlled by controlling a torque of the electric motor 30 or a quantity indicative of the torque of the electric motor 30. According to an embodiment, the torque of the electric motor 30 can be monitored or controlled by monitoring or controlling a current of the electric motor. According to an embodiment, the tension limit value, e.g. when set by a user or an operator of the winch arrangement, may be represented by a motor torque % or a true force in kgs/lbs, for instance.

According to an embodiment, the winch arrangement of the tug 100 may be provided with an automatic overload protection system (AOPS) and/or manual overload protection system (MOPS). Such functionality may be provided by the electric drive 40. AOPS generally refers to a system that automatically safeguards and protects the winch against overload and over-moment during operation by allowing the hook of the winch to be pulled away from the winch in order to avoid significant damage. MOPS generally refers to a system, activated by the winch operator, protecting the winch against overload and over-moment by reducing the load-carrying capacity and allowing the hook to be pulled away from the winch. Term over-moment generally refers to a load moment which exceeds a maximum load moment (safe working load (SWL) multiplied by radius).

An apparatus implementing the control functions according to any one of the above embodiments, or a combination thereof, may be implemented as one unit or as two or more separate units that are configured to implement the functionality of the various embodiments. Here the term 'unit' refers generally to a physical or logical entity, such as a physical device or a part thereof or a software routine. One or more of these units, such as the control arrangement 41, may reside in the electric drive 40 or a component thereof, such as the inverter 42, for example.

An apparatus, such as the control arrangement 41, according to any one of the embodiments may be implemented at least partly by means of one or more computers or corresponding digital signal processing (DSP) equipment provided with suitable software, for example. Such a computer or digital signal processing equipment preferably comprises at least a working memory (RAM) providing storage area for arithmetical operations and a central processing unit (CPU), such as a general-purpose digital signal processor. The CPU may comprise a set of registers, an arithmetic logic unit, and a CPU control unit. The CPU control unit is controlled by a sequence of program instructions transferred to the CPU from the RAM. The CPU control unit may contain a number of microinstructions for basic operations. The implementation of microinstructions may vary depending on the CPU design. The program instructions may be coded by a programming language, which may be a high-level programming language, such as C, Java, etc., or a low-level programming language, such as a machine language, or an assembler. The computer may also have an operating system, which may provide system services to a computer program written with the program instructions. The computer or other apparatus implementing the invention, or a part thereof, may further comprise suitable input means for receiving e.g. measurement and/or control data, and output means for outputting e.g. control data. It is also possible to use a specific integrated circuit or circuits, or discrete electric components and devices for implementing the functionality according to any one of the embodiments.

The invention according to any one of the embodiments, or any combination thereof, can be implemented in existing system elements, such as electric drives or components thereof, such as inverters or frequency converters, or similar devices, or by using separate dedicated elements or devices in a centralized or distributed manner. Present devices for electric drives, such as inverters and frequency converters, typically comprise processors and memory that can be utilized in the functions according to embodiments of the invention. Thus, all modifications and configurations required for implementing an embodiment of the invention e.g. in existing devices may be performed as software routines, which may be implemented as added or updated software routines. If the functionality of the invention is implemented by software, such software can be provided as a computer program product comprising computer program code which, when run on a computer, causes the computer or corresponding arrangement to perform the functionality according to the invention as described above. Such a computer program code may be stored or generally embodied on a computer readable medium, such as suitable memory, e.g. a flash memory or a disc memory from which it is loadable to the unit or units executing the program code. In addition, such a computer program code implementing the invention may be loaded to the unit or units executing the computer program code via a suitable data network, for example, and it may replace or update a possibly existing program code.

It is obvious to a person skilled in the art that as technology advances, the basic idea of the invention can be implemented in a variety of ways. Consequently, the invention and its embodiments are not restricted to the above examples, but can vary within the scope of the claims.

The invention claimed is:

1. A method for operating a towing winch of a tug, the towing winch comprising a rotatable winch drum for spooling a spoolable medium, an electric motor operably coupled to the winch drum to rotate the winch drum, an electric drive operably coupled to the electric motor to control the electric motor, the method comprising:

controlling by the electric drive, during a towing of at least one object connected to the spoolable medium, a tension of the spoolable medium between the winch drum and the at least one object to be towed to be equal to or lower than a tension limit value; and monitoring by the electric drive, during the towing, a roll angle of the tug, and in response to the monitored roll angle of the tug being outside of a predetermined range, lowering by the electric drive the tension limit value.

2. The method of claim 1, wherein the tension limit value is lowered proportionally to the roll angle of the tug by the electric drive in response to the monitored roll angle of the tug being outside of a predetermined range.

3. The method of claim 1, wherein the monitoring of the roll angle of the tug by the electric drive comprises measuring the roll angle of the tug in the electric drive.

4. The method of claim 3, wherein the electric drive comprises a motion reference device configured to measure the roll angle of the tug.

5. The method of claim 1, wherein the monitoring of the roll angle of the tug by the electric drive comprises receiving the roll angle of the tug in the electric drive.

6. The method of claim 5, wherein the electric drive is connected to a motion reference device configured to measure the roll angle of the tug.

7. The method of claim 1, wherein the tension of the spoolable medium is controlled by controlling a torque of the electric motor.

8. A controller for an electric drive configured for operating a towing winch of a tug, comprising a processor, and a non-transitory computer readable media storing instructions that, when executed by the processor, cause the controller to:

control by the electric drive, during a towing of at least one object connected to a spoolable medium, a tension of the spoolable medium between a winch drum and an object to be towed to be equal to or lower than a tension limit value; and monitor by the electric drive, during the towing, a roll angle of the tug, and in response to the monitored roll angle of the tug being outside of a predetermined range, lowering by the electric drive the tension limit value.

9. An electric drive for a towing winch of a tug, the towing winch comprising a rotatable winch drum for spooling a spoolable medium, and an electric motor operably coupled to the winch drum to rotate the winch drum, wherein the electric drive is configured to be operably coupled to the electric motor, and configured to:

control, during a towing of at least one object connected to the spoolable medium, a tension of the spoolable medium between the winch drum and the at least one object to be towed to be equal to or lower than a tension limit value; and monitor, during the towing, a roll angle of the tug, and in response to the monitored roll angle of the tug being outside of a predetermined range, lower the tension limit value.

10. The electric drive of claim 9, wherein the electric drive is configured to lower the tension limit value proportionally to the roll angle of the tug in response to the monitored roll angle of the tug being outside of a predetermined range.

11. The electric drive of claim 9, wherein the electric drive comprises a motion reference device configured to measure the roll angle of the tug.

12. The electric drive of claim 9, wherein the electric drive is configured to receive the roll angle of the tug.

13. The electric drive of claim 9, wherein the electric drive is configured to control the tension of the spoolable medium by controlling a torque of the electric motor.

14. The electric drive of claim 9, comprising an inverter.

15. A winch arrangement for a tug, comprising:

a rotatable winch drum for spooling a spoolable medium;

an electric motor operably coupled to the winch drum to rotate the winch drum; and an electric drive operably coupled to the electric motor, the electric drive comprising a processor, and a memory storing instructions that, when executed by the processor, cause the electric drive to:

control, during a towing of at least one object connected to the spoolable medium, a tension of the spoolable medium between the winch drum and the at least one object to be towed to be equal to or lower than a tension limit value; and monitor, during the towing, a roll angle of the tug, and in response to the monitored roll angle of the tug being outside of a predetermined range, lowering by the electric drive the tension limit value.

* * * * *